US009732963B2

(12) United States Patent
Kozinski et al.

(10) Patent No.: US 9,732,963 B2
(45) Date of Patent: Aug. 15, 2017

(54) APPLIANCE CONTROL PANEL ASSEMBLY

(71) Applicant: General Electric Company, Schenectady, NY (US)

(72) Inventors: Kyle Andrew Kozinski, Louisville, KY (US); Gonzalo Luis Ocano, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 300 days.

(21) Appl. No.: 14/741,589

(22) Filed: Jun. 17, 2015

(65) Prior Publication Data

US 2016/0370013 A1 Dec. 22, 2016

(51) Int. Cl.
*F24C 3/12* (2006.01)
*F24C 5/16* (2006.01)
*F24C 7/08* (2006.01)

(52) U.S. Cl.
CPC ..... *F24C 3/124* (2013.01); *F24C 5/16* (2013.01); *F24C 7/086* (2013.01)

(58) Field of Classification Search
None
See application file for complete search history.

(56) References Cited

U.S. PATENT DOCUMENTS 4,336,569 A * 6/1982 Tsuda ..... F24C 7/082 219/702
4,908,738 A * 3/1990 Kobari ..... H02M 7/003 361/757
5,138,527 A * 8/1992 Jones ..... H05K 5/0017 174/67
5,366,185 A 11/1994 Michael et al.
5,418,693 A * 5/1995 Perry ..... G01D 3/08 361/748
5,464,955 A * 11/1995 Cole ..... H01H 19/025 200/312
5,828,543 A * 10/1998 Leveque ..... H05K 3/326 29/832
5,850,333 A * 12/1998 Owanesian ..... H05K 5/0213 165/185
5,982,103 A * 11/1999 Mosebrook ..... H01Q 1/007 315/149
6,750,407 B2 * 6/2004 Song ..... B29C 45/1418 200/310
7,117,510 B2 * 10/2006 Lu ..... B60R 11/02 720/647
7,724,540 B1 * 5/2010 Salinas Fox ..... H05K 7/142 174/138 G
7,752,871 B2 * 7/2010 Cho ..... D06F 39/12 68/12.01

(Continued)

FOREIGN PATENT DOCUMENTS

KR 20020030654 4/2002

*Primary Examiner* — Xanthia C Cunningham
(74) *Attorney, Agent, or Firm* — Dority & Manning, P.A.

(57) ABSTRACT

A control panel assembly for an appliance with features for securing a backing plate to a control panel frame to maintain a high quality fit, feel, and finish of the control panel assembly is provided. In particular, the backing plate includes a plurality of securing tabs for securing the backing plate against the control panel frame. The backing plate also may include a plurality of spring tabs for securing the backing plate against the control panel frame.

18 Claims, 6 Drawing Sheets

(56) References Cited

U.S. PATENT DOCUMENTS

| | | | | |
|---|---|---|---|---|
| 8,199,526 | B2 * | 6/2012 | Yu | G06F 1/181 312/215 |
| 8,289,722 | B2 * | 10/2012 | Furubo | H05K 5/0217 361/679.01 |
| 8,480,186 | B2 * | 7/2013 | Wang | H05K 5/0013 312/223.1 |
| 9,080,272 | B2 * | 7/2015 | Kim | D06F 39/005 |
| 9,220,394 | B2 * | 12/2015 | Heater | A47L 15/4293 |
| 9,429,176 | B2 * | 8/2016 | Morris | F16B 2/22 |
| 9,456,095 | B2 * | 9/2016 | Tsubakimoto | F16B 5/0664 |
| 2005/0155394 | A1 * | 7/2005 | Brauchle | H05K 5/0004 68/3 R |
| 2005/0183471 | A1 * | 8/2005 | Kang | D06F 9/005 68/12.27 |
| 2009/0040737 | A1 * | 2/2009 | Shimura | G07C 9/00944 361/752 |
| 2010/0027226 | A1 * | 2/2010 | Lin | G06F 3/041 361/752 |
| 2010/0177494 | A1 * | 7/2010 | Kim | D06F 39/005 361/837 |
| 2010/0218565 | A1 * | 9/2010 | Wan | A47L 15/4293 68/13 R |
| 2011/0030669 | A1 * | 2/2011 | Leikam | F24C 3/124 126/1 R |
| 2011/0214978 | A1 * | 9/2011 | Byrne | H03K 17/975 200/600 |
| 2014/0049926 | A1 * | 2/2014 | Bas | D06F 39/005 361/759 |
| 2016/0179235 | A1 * | 6/2016 | Winkelmann | F24C 7/086 345/173 |
| 2016/0334111 | A1 * | 11/2016 | Kim | F24C 7/086 |

* cited by examiner

APPLIANCE CONTROL PANEL ASSEMBLY

FIELD OF THE INVENTION

The subject matter of the present disclosure relates generally to control panels for appliances, in particular cooktop appliances.

BACKGROUND OF THE INVENTION

Cooktop appliances, such as, e.g., oven range appliances, generally include a cooktop having one or more heated portions for heating or cooking food items within a cooking utensil placed on a heated portion. Oven range appliances usually also include a cabinet that defines a cooking chamber for cooking food items placed therein. Typically, a control panel is provided having one or more controls that a user of the appliance may select various options for the operation of the heated portions and the cooking chamber, as well as other features of the appliance. The appliance usually is operated by a controller or other control mechanism. Other appliances, such as, e.g., washing machine and dryer appliances, also may include a control panel including controls that a user may manipulate to select options for operating the appliance.

Some control panel assemblies include touch-type controls, whereby the user touches a glass panel of the control panel assembly to select an option. Generally, the glass panel is affixed to a frame with metal brackets and fasteners such as screws, which require tight adherence to manufacturing process and tolerances to properly assembly the control panel assembly. The glass panel is expensive, and a large number of parts are required to secure the glass panel and other portions of the control assembly to the frame, which increases the complexity and expense of the manufacturing process. Therefore, a control panel assembly that costs less to manufacture and allows for a high degree of manufacturing process and tolerance variations while maintaining a high quality fit, feel, and finish of the control panel assembly would be desirable.

BRIEF DESCRIPTION OF THE INVENTION

The present invention provides a control panel assembly for an appliance with features for securing a backing plate to a control panel frame to maintain a high quality fit, feel, and finish of the control panel assembly. In particular, the backing plate includes a plurality of securing tabs for securing the backing plate against the control panel frame. In certain embodiments, the backing plate further includes a plurality of spring tabs for securing the backing plate against the control panel frame. Additional aspects and advantages of the invention will be set forth in part in the following description, may be apparent from the description, or may be learned through practice of the invention.

In a first exemplary embodiment, a control panel assembly for an appliance is provided. The control panel assembly includes a control panel frame having a frame flange around an edge thereof; a backing plate adjacent the control panel frame, the backing plate defining a plurality of securing tabs extending from an edge thereof, each securing tab defining an aperture along its length, the backing plate further defining a spacer flange, the spacer flange extending toward the control panel frame; a control assembly including a control element positioned within a control housing; and an overlay positioned between the control panel frame and the backing plate. Each securing tab of the backing plate has an uninstalled position and an installed position, wherein an end of each securing tab farthest from the backing plate is at a greater distance from the backing plate in the installed position than in the uninstalled position.

In a second exemplary embodiment, a control panel assembly for an appliance is provided. The control panel assembly includes a control panel frame having a frame flange around an edge thereof; and a backing plate adjacent the control panel frame, the backing plate defining a plurality of securing tabs extending from a first edge thereof. Each securing tab defines an aperture along its length, and the backing plate further defines a plurality of spring tabs extending from a second edge thereof. Each securing tab of the backing plate has an uninstalled position and an installed position, and each spring tab has an uninstalled position and an installed position. At least a portion of the plurality of securing tabs contacts the control panel frame in the installed position of the securing tabs and at least a portion of the plurality of spring tabs contacts the control panel frame in the installed position of the spring tabs.

These and other features, aspects, and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

Use of identical reference numerals in different figures denotes the same or similar components or features.

DETAILED DESCRIPTION OF THE INVENTION

Figure 1:
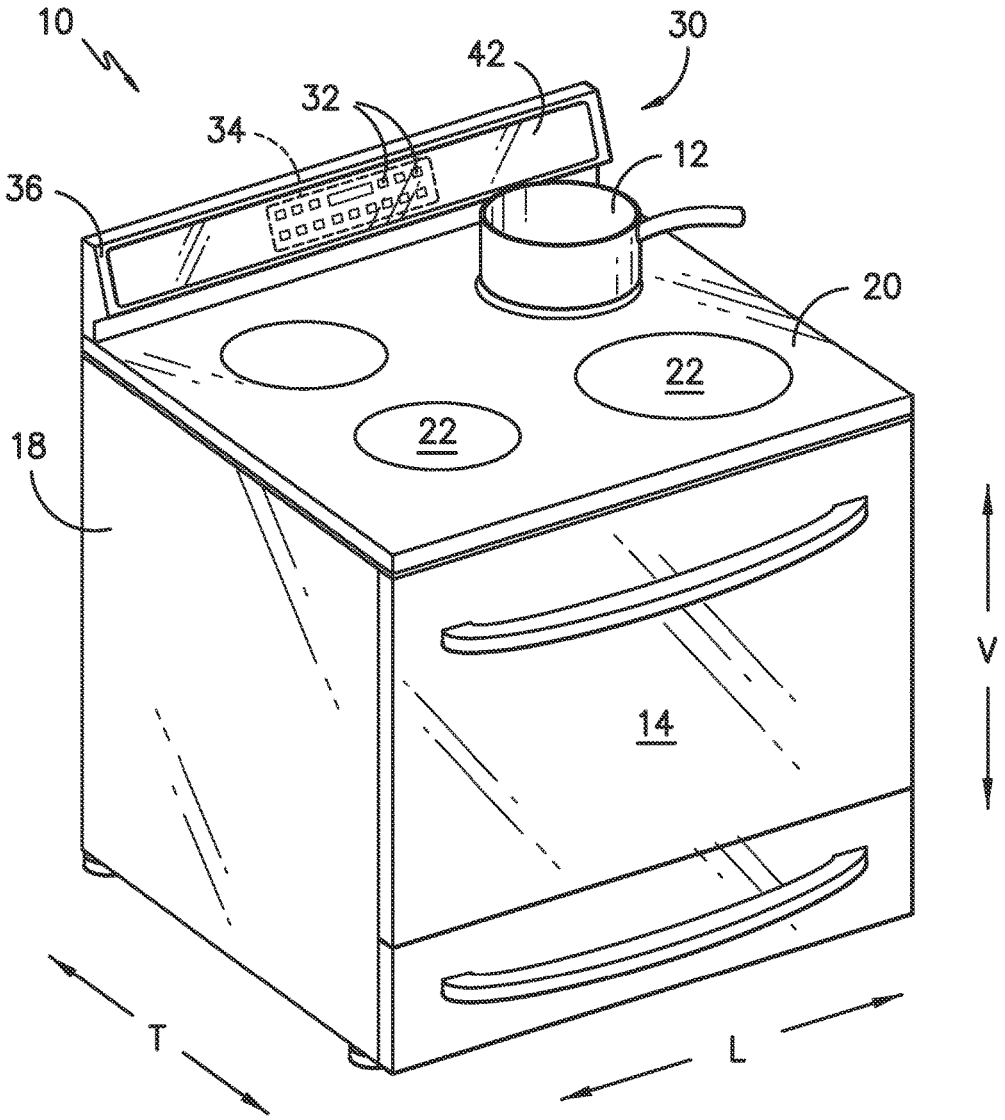
FIG. 1 provides a side, perspective view of a cooktop or oven range appliance according to the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides a perspective view of an oven range appliance 10 having a cooktop 20. Oven range appliance 10 is provided by way of example only and is not intended to limit the present subject matter in any aspect. Thus, the present subject matter may be used with other cooktop appliance configurations, e.g., cooktop appliances having only a cooktop or oven range appliances that define one or more interior cavities for the receipt of food. Further, the present subject matter may be used in any other suitable appliance.

Cooktop 20 of oven range appliance 10 includes heated portions 22, which may be heated by any suitable heating element or combination of heating elements, e.g., electrical resistive heating elements, gas burners, induction heating elements, and/or any other appropriate heating element. That is, each heated portion 22 of cooktop 10 may be heated by the same type of heating element, or cooktop 10 may include a combination of different types of heating elements. Further, heated portions 22 may have any suitable shape and size, and a combination of heated portions of different shapes and sizes may be used.

As shown in FIG. 1, a cooking utensil 12, such as a pot, pan, or the like, may be placed on a heated portion 22 to cook or heat food items placed in the cooking utensil. Oven range appliance 10 also includes a door 14 that permits access to a cooking chamber (not shown) of an insulated cabinet 16 of appliance 10, e.g., for cooking or baking of food items in the cooking chamber. A handle 18 is mounted to door 14 and assists a user with opening and closing door 14. For example, a user can pull on handle 18 to open or close door 14 and access the cooking chamber.

A control panel assembly 30 having controls 32 permits a user to make selections for cooking of food items. Although shown on a backsplash or back panel of cooktop 10, control panel assembly 30 may be positioned in any suitable location. Further, while shown with touch-type controls, controls 32 may include buttons, knobs, and the like, as well as combinations thereof. A user may manipulate one or more controls 32 to select a temperature and/or a heat or power output for the heating element(s) of each heated portion 22. Control panel assembly 30 is further described below.

The operation of oven range appliance 10, including the heating elements of heated portions 22, may be controlled by a processing device such as a controller 34 having one or more control elements, which may include a microprocessor or other device that is in operative communication with components of appliance 10. Controller 34 may include a memory and microprocessor, such as a general or special purpose microprocessor operable to execute programming instructions or micro-control code associated with a cleaning cycle. The memory may represent random access memory such as DRAM, and/or read only memory such as ROM or FLASH. In one embodiment, the processor executes programming instructions stored in memory. The memory may be a separate component from the processor or may be included onboard within the processor. Alternatively, controller 34 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. In some embodiments, one or more control elements forming controller 34 may comprise one or more printed circuit boards. Additionally or alternatively, controls 32 and other components of oven range appliance 10 may be in communication with controller 34 via one or more signal lines or shared communication busses.

Figure 2:
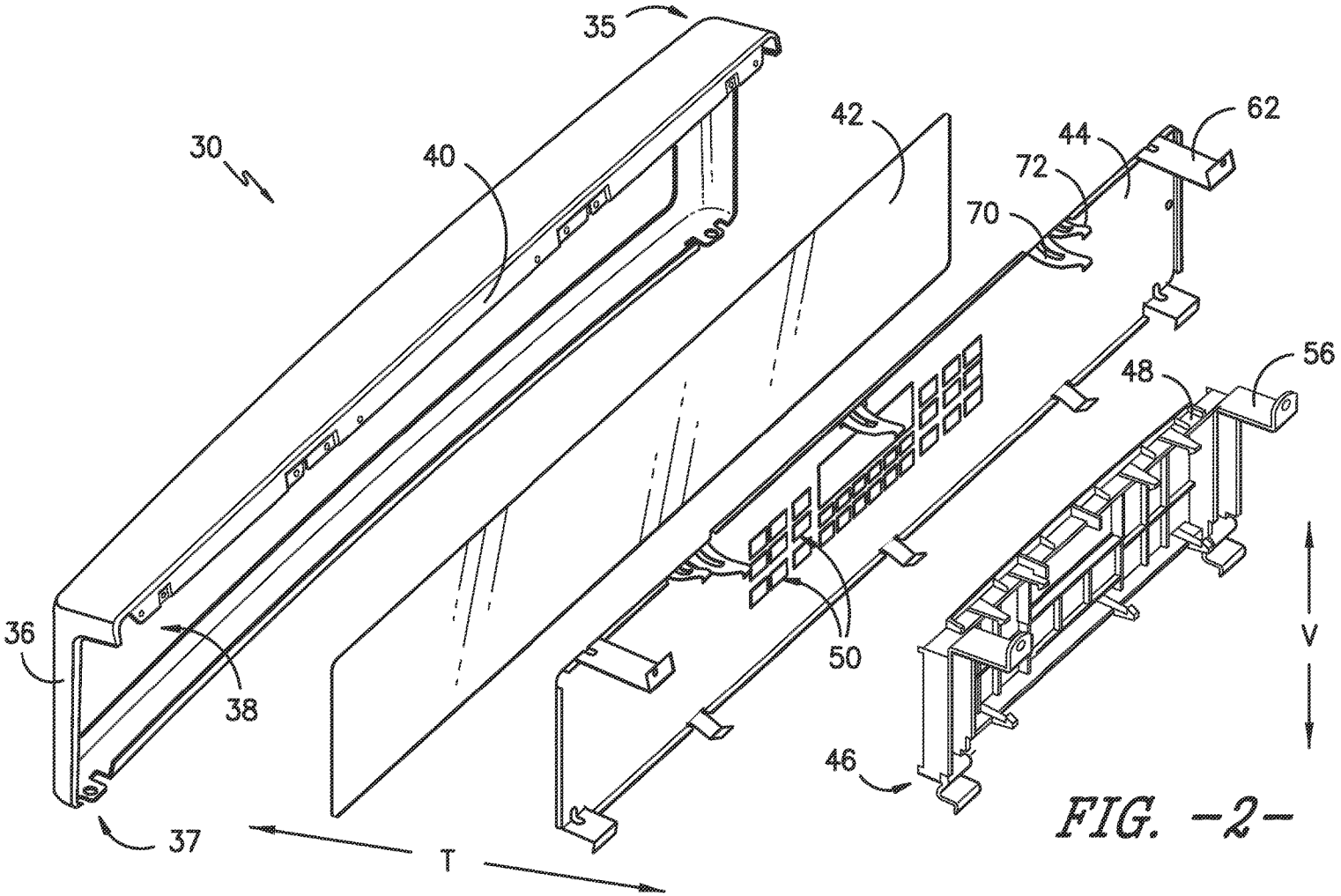
FIG. 2 provides an exploded, back view of a control panel assembly according to an exemplary embodiment of the present subject matter.

FIG. 2 provides an exploded view of control panel assembly 30 according to an exemplary embodiment of the present subject matter. As shown, control panel assembly 30 includes a control panel frame 36 defining an opening 38 and having a frame flange 40 extending along the transverse direction T. Control panel frame 36 is generally rectangular in shape, and in some embodiments, frame flange 40 extends from all four edges of frame 36. In other embodiments, frame flange 40 extends from only a portion of the edges of frame 36, such as the top and bottom edges, the opposing edges that are spaced apart along the vertical direction V in FIG. 2. Frame flange 40 may define a channel 41 between flange 40 and the remainder of control panel frame 36. Other configurations of control panel frame 36 may be used as well.

Control panel assembly 30 further includes an overlay 42 positioned between control panel frame 36 and a backing plate 44. Overlay 42 is visible to and accessible by a user of appliance 10 through opening 38 in control panel frame 36. Controls 32 may be selected or manipulated by touch inputs of a user of appliance 10 to overlay 42. For example, various text, graphics, and/or symbols may be printed on overlay 42 that correspond with controls 32 such that when a user touches a printed text, graphic, and/or symbol, the corresponding control 32 is selected or manipulated. Such selection or manipulation of controls 32 is sensed as an input by controller 34 or other control mechanism to operate appliance 10.

Overlay 42 is wider and longer than opening 38 defined in control panel frame 36 such that overlay 42 is held in place against the portions of frame 36 surrounding opening 38 by backing plate 44. Further, overlay 42 may be formed from any suitable material, such as, e.g., a plastic film, a thin plastic sheet, or the like. In some embodiments, overlay 42 may be a substantially transparent or translucent material for the passage of light therethrough. In other embodiments, overlay 42 may be a substantially transparent or translucent material such that the various text, graphics, and/or symbols may be printed on a surface of overlay 42 opposite a surface that is touched by users, i.e., such that the text, graphics, and/or symbols are visible to a user but are not directly touched by the user. In still other embodiments, overlay 42 may be a substantially opaque material, and the various text, graphics, and/or symbols may be printed on the surface users touch to select or manipulate controls 32. Overlay 42 also may have other configurations.

Control panel assembly 30 also includes a control assembly 46. Control assembly 46 includes at least one control element of controller 34 positioned within a control housing 48. As illustrated in FIG. 2, a plurality of apertures 50 may be provided in backing plate 44 such that the control element within housing 48 and/or another element of controller 34 in operative communication with controls 32 can sense touch inputs to overlay 42 by a user of appliance 10, i.e., can sense the selection or manipulation of controls 32. Alternatively or additionally, apertures 50 may allow light from one or more light sources of the control element and/or controller 34 to be directed to overlay 42, e.g., to create a lighted display or to illuminate features of overlay 42. Other configurations of control assembly 46 may be used as well.

Figure 3:
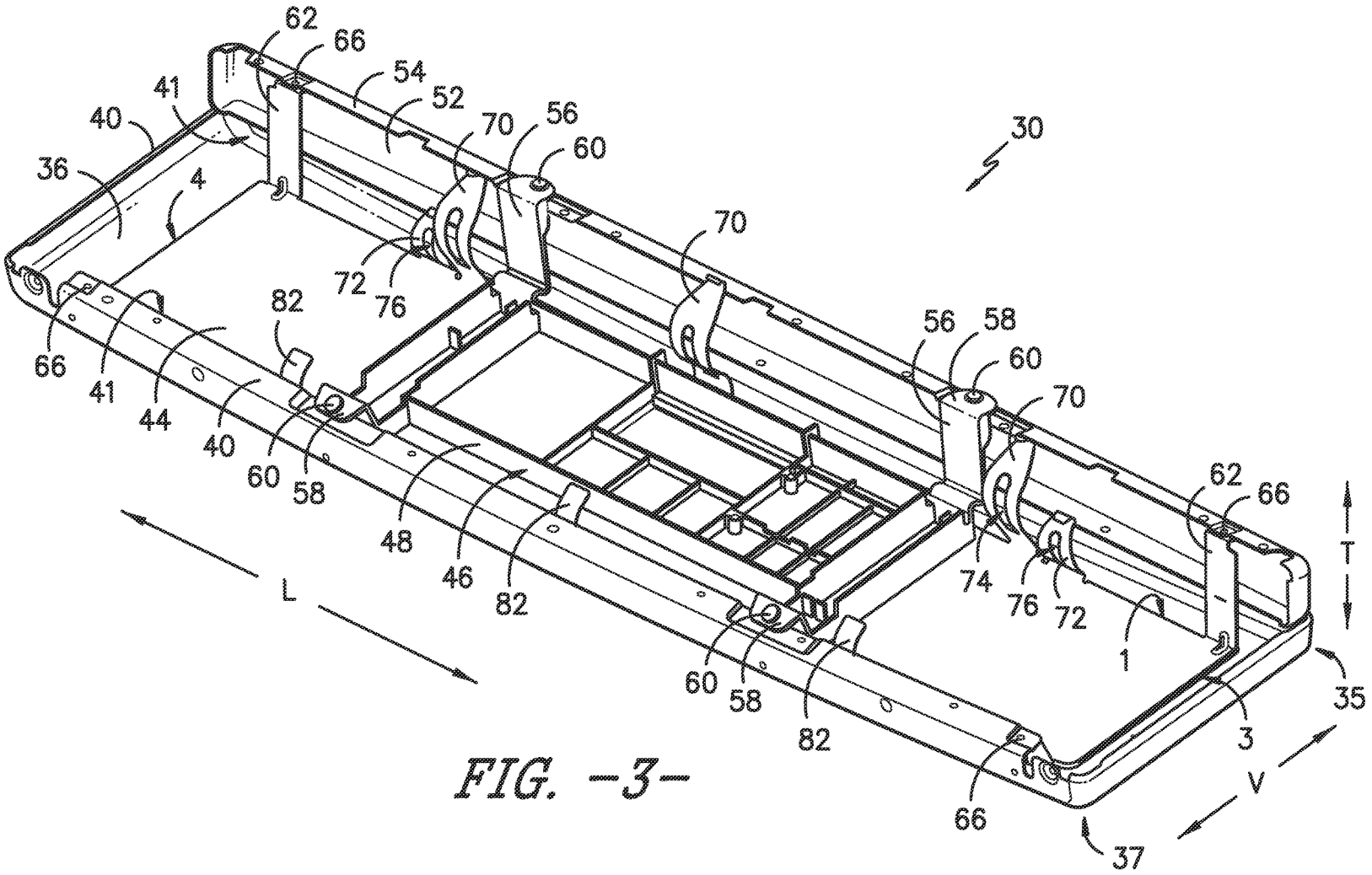
FIG. 3 provides an assembled, back view of the control panel assembly of FIG. 2, with the securing tabs and spring tabs of a backing plate of the assembly in an uninstalled position according to an exemplary embodiment of the present subject matter.

FIG. 3 provides a perspective view of the back of control panel assembly 30 of FIG. 2. More particularly, FIG. 3 provides a view of an assembled control panel assembly 30 opposite the area in which a user accesses controls 32. As shown, control panel assembly 30 may include an extension element 52 extending along the longitudinal direction L adjacent a top 35 of control panel frame 36. Extension element 52 may keep control panel assembly 30 from contacting, e.g., a wall of a kitchen in which oven range appliance 10 is located, or extension element 52 may provide additional rigidity to control panel assembly 30. Extension element 52 also may enhance the appearance of control panel assembly 30 and/or appliance 10, as well as prevent access to the back of control panel assembly 30 during normal operation. In some embodiments, extension element 52 may be connected, fixed, attached, secured, or coupled to control panel frame 36 using appropriate fasteners, e.g., screws or the like, or using any suitable mechanism. In other embodiments, extension element 52 may be incorporated into control panel frame 36, e.g., a frame flange 40 of frame 36 may extend farther than, or be longer than, other flanges 40 of frame 36. As further shown in FIG. 3, extension element 52 includes at least one extension flange 54. Extension element 52 also may have other configurations or functions.

Further, when control panel assembly 30 is assembled, control housing 48 of control assembly 46 is positioned against backing plate 44. As shown in FIG. 3, control housing 48 may define a plurality of fastener tabs 56 for attaching control housing 48 to control panel frame 36 and/or extension element 52. That is, in embodiments of assembly 30 without extension element 52, control housing 48 is attached to frame 36, and in embodiments including extension element 52, control housing 48 is attached to frame 36, extension element 52, or both. In the exemplary embodiment of FIG. 3, control housing 48 is secured to both control panel frame 36 and extension element 52.

Fastener tabs 56 extend from control housing 48 generally along the transverse direction T, and each tab 56 defines a plate 58 extending generally perpendicular to tab 56, i.e., along the vertical direction V in the exemplary embodiment shown in FIG. 3. A fastener 60 may be inserted through each plate 60 to attach control housing 48 to control panel frame 36 and/or extension element 52. More particularly, each plate 58 may be defined such that plate 58 extends parallel and adjacent to frame flange 40 and/or extension flange 54 such that fastener 60 may be inserted through plate 58 and frame flange 40 and/or extension flange 54 to secure control housing 48 in place. Using fastener tabs 56, control housing 48 may be connected, fixed, attached, secured, or coupled to control panel frame 36 and/or extension element 52 using appropriate fasteners 60, e.g., screws or the like, or using any suitable mechanism. Fastener tabs 56 may have other configurations as well.

As further illustrated in FIG. 3, backing plate 44 is installed against control panel frame 36 to support overlay 42 and hold overlay 42 (not shown) in place against frame 36. Backing plate 44 may be formed or fabricated from a metal material or any other appropriate material. As shown in FIG. 3, backing plate 44 defines a plurality of fastener tabs 62 for attaching backing plate 44 to control panel frame 36 and/or extension element 52. In particular, fastener tabs 62 assist in locating backing plate 44 with respect to control panel frame 36 and provide support to backing plate 44 when attached to frame 36 and/or extension element 52. In the exemplary embodiment shown in FIG. 3, a fastener tab 62 is defined at each corner 64 of backing plate 44; thus, fastener tabs 62 provide support for backing plate 44 at corners 64.

In embodiments of assembly 30 without extension element 52, backing plate 44 is attached to frame 36 using fastener tabs 62. In embodiments including extension element 52, fastener tabs 62 attach backing plate 44 to frame 36, extension element 52, or both. In the exemplary embodiment illustrated in FIG. 3, backing plate 44 is secured to both control panel frame 36 and extension element 52 using fastener tabs 62.

Fastener tabs 62 of backing plate 44 may be substantially similar to fastener tabs 56 of control housing 48. For example, each tab 62 may extend generally along the transverse direction T. Further, each tab 62 may define a plate (not shown) extending generally along the vertical direction V through which a fastener 66 may be inserted to secure backing plate 44 to control panel frame 36 and/or extension element 52. Using fastener tabs 62, backing plate 44 may be connected, fixed, attached, secured, or coupled to control panel frame 36 and/or extension element 52 using appropriate fasteners 66, e.g., screws or the like, or using any suitable mechanism. Although described as similar to fastener tabs 56, fastener tabs 62 may have other configurations as well, i.e., fastener tabs 62 may be configured differently than fastener tabs 56 or may be configured differently than as described herein with respect to the exemplary embodiment of FIG. 3. In some embodiments, fastener tabs 62 may be unnecessary and, thus, may be eliminated.

As shown in FIG. 3, backing plate 44 further defines a plurality of securing tabs for holding backing plate 44 in place and/or for providing support for backing plate 44 when a user touches or presses on overlay 42. A first portion of the plurality of securing tabs may be first securing tabs 70 and a second portion of the plurality of securing tabs may be second securing tabs 72. The plurality of securing tabs may extend from one or more edges of backing plate 44, such as a first edge 1, a second edge 2, a third edge 3, and/or a fourth edge 4. In the exemplary embodiment of FIG. 3, each securing tab 70, 72 extends generally from first edge 1 along the transverse direction T, where first edge 1 is spaced apart from second edge 2 along the vertical direction V such that first edge 1 is a top edge of backing plate 44 and second edge 2 is a bottom edge of backing plate 44. Third and fourth edges 3, 4 are spaced apart along the longitudinal direction L such that third and fourth edges 3, 4 are side edges of backing plate 44.

As shown, first securing tabs 70 generally may be longer than second securing tabs 72, i.e., first securing tabs 70 may extend farther from backing plate 44 than second securing tabs 72. In some embodiments, backing plate 44 may define only first securing tabs 70 or only second securing tabs 72; in other embodiments, backing plate defines both first and second securing tabs 70, 72 such that a first portion of the securing tabs are first securing tabs 70 and the remaining, or second, portion of the securing tabs are second securing tabs 72. In still other embodiments, backing plate 44 may define a plurality of securing tabs in a plurality of different lengths, e.g., a first portion of the securing tabs may be first securing tabs 70, a second portion of the securing tabs may be second securing tabs 72, and the remaining portion of the securing tabs may be securing tabs other than first and second securing tabs 70, 72. The length of each securing tab may depend on the geometry of control panel frame 36 and/or extension element 52, as the securing tabs provide an interference fit between backing plate 44 and frame 36 and/or extension element 52, as further described below.

Figure 4:
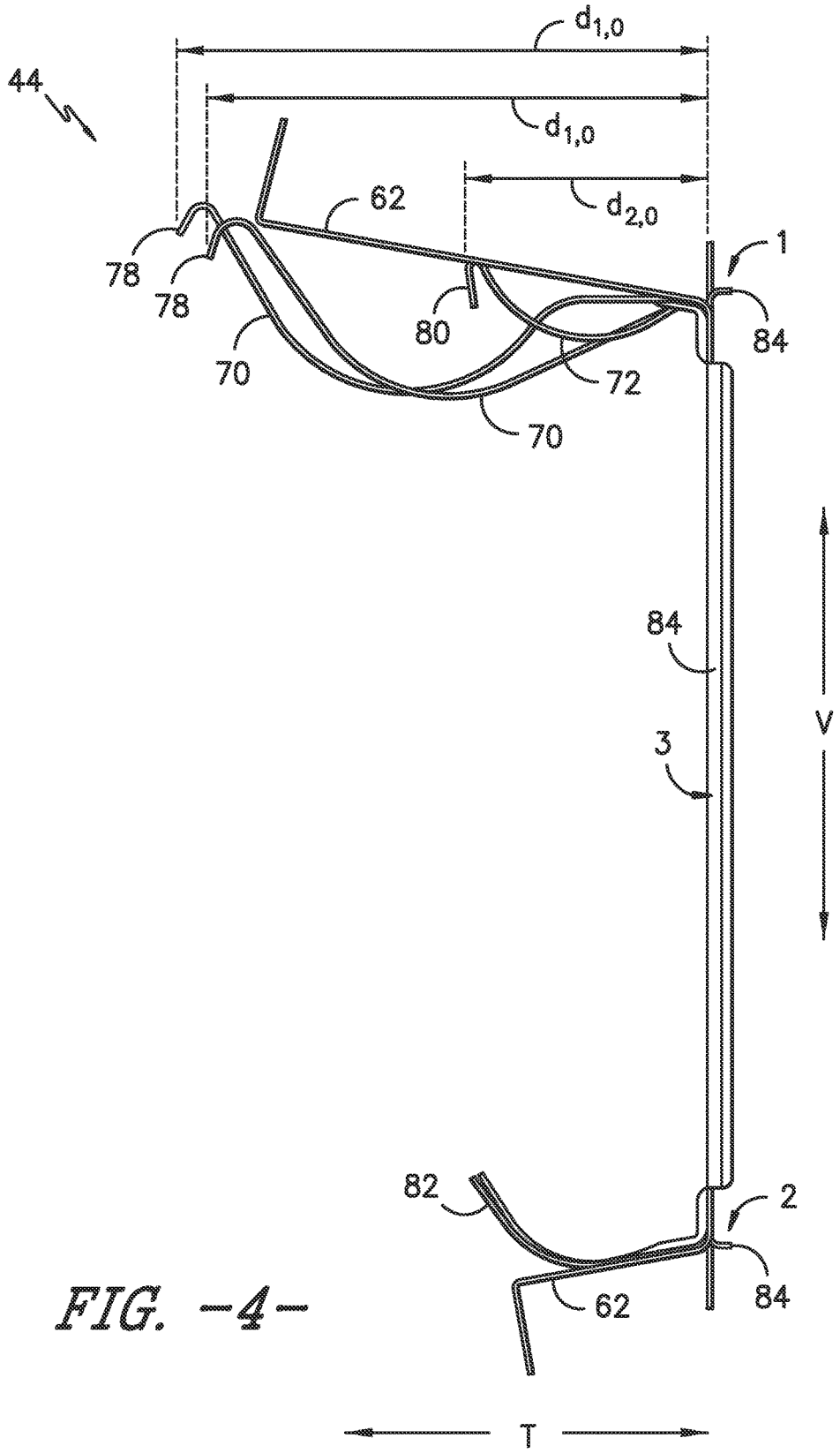
FIG. 4 provides a side view of a backing plate of a control panel assembly according to an exemplary embodiment of the present subject matter.

Moreover, a hook-shaped or J-shaped portion is defined at an end of each securing tab farthest from backing plate 44. As shown in FIG. 4, each first securing tab 70 defines hook-shaped or J-shaped portion 78 and each second securing tab 72 defines hook-shaped or J-shaped portion 80. Further, each securing tab defines an aperture along its length. For example, referring back to FIG. 3, each first securing tab 70 defines an aperture 74 along the length thereof, and each second securing tab 72 defines an aperture 76 along the length thereof. Each aperture 74, 76 may extend along a suitable portion of tabs 70, 72, e.g., apertures 74, 76 may extend along a substantial portion of the length of tabs 70, 72. Alternatively or additionally, a plurality of apertures may be defined along the length of each securing tab. Further, each aperture may have any appropriate shape, such as, e.g., generally oval, pill-shaped, rectangular, or the like.

Figure 5:
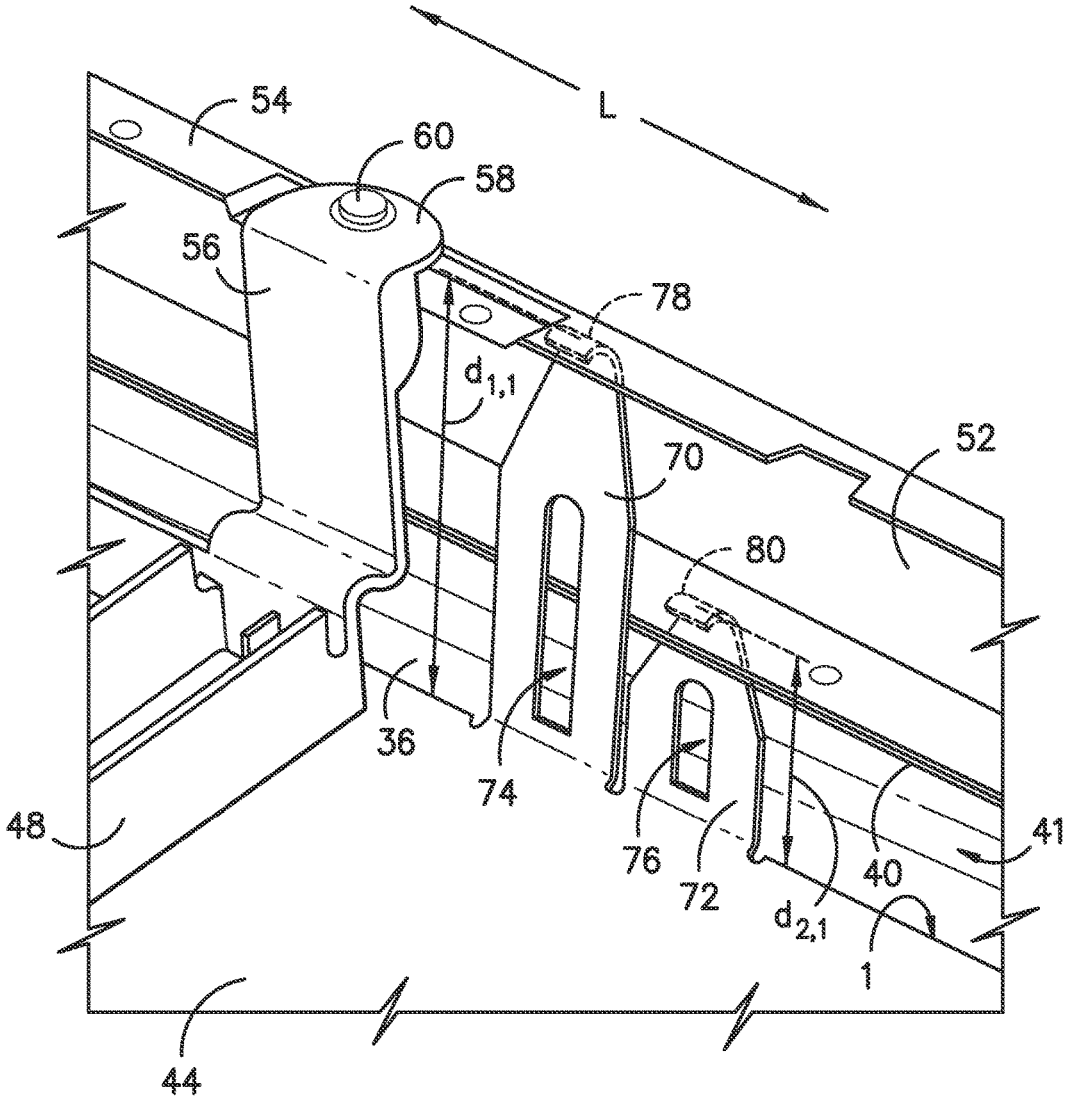
FIG. 5 provides a perspective view of a portion of a control panel assembly, with the securing tabs of a backing plate of the assembly in an installed position according to an exemplary embodiment of the present subject matter.

FIGS. 3 and 4 illustrate the plurality of securing tabs of backing plate 44 in an uninstalled position. As shown, each securing tab is bent or curved along its length. For example, first securing tabs 70 are curved along their length and second securing tabs 72 are curved along their length. FIG. 5 illustrates exemplary securing tabs in an installed position. As shown, first securing tab 70 has been straightened along its length such that hook-shaped portion 78 contacts extension flange 54 and first securing tab 70 is less curved along its length than in the uninstalled position. Similarly, second securing tab 72 has been straightened along its length such that hook-shaped portion 80 contacts frame flange 40 and second securing tab 72 is less curved along its length than in the uninstalled position. Through the contact between securing tabs 70, 72 and flanges 54, 50, an interference fit is provided between backing plate 44 and control panel frame 36 having extension element 52 attached or coupled thereto.

The plurality of securing tabs may be straightened and, thus, installed against control panel frame 36 and/or extension element 52 by applying pressure on the aperture defined by each securing tab. That is, each securing tab 70, 72 may be deformable such that by applying pressure to each aperture 74, 76, securing tabs are deformed such that they are less curved along their lengths. The securing tabs are thereby placed in an interference fit with control panel frame 36 and/or extension element 52 to hold backing plate 44 in place and/or to provide support to backing plate 44. That is, when the securing tabs are in the installed position, at least a portion of the plurality of securing tabs is in contact with control panel frame 36 and/or extension element 52 to hold backing plate 44 in place and/or to provide support to backing plate 44.

In the exemplary embodiment shown in FIG. 4, before securing tabs 70, 72 are installed against control panel frame 36 and extension element 52, i.e., when tabs 70, 72 are in an uninstalled position and are generally curved along their lengths, hook-shaped portion 78 of first securing tabs 70 is at an uninstalled distance $d_{1,0}$ from backing plate 44 and hook-shaped portion 80 of second securing tabs 72 is at an uninstalled distance $d_{2,0}$ from backing plate 44. As shown in FIG. 5, after securing tabs 70, 72 are installed against control panel frame 36 and extension element 52, i.e., when tabs 70, 72 are in an installed position and are generally less curved along their lengths, hook-shaped portion 78 of first securing tabs 70 is at an installed distance $d_{1,1}$ from backing plate 44 and hook-shaped portion 80 of second securing tabs 72 is at an installed distance $d_{2,1}$ from backing plate 44. Uninstalled distance $d_{1,0}$ of first securing tabs 70 is less than installed distance $d_{1,1}$ of first securing tabs 70, and uninstalled distance $d_{2,0}$ of second securing tabs 72 is less than installed distance $d_{2,1}$ of second securing tabs 72. That is, hook-shaped portion 78 of first securing tabs 70 and hook-shaped portion 80 of second securing tabs 72 are at a greater distance from backing plate 44 when tabs 70, 72 are installed against control panel frame 36 and extension element 52 than when tabs 70, 72 are uninstalled.

Referring back to FIG. 3, backing plate 44 further defines a plurality of spring tabs 82 for holding backing plate 44 in place and providing support for backing plate 44 when a user touches or presses on overlay 42. The plurality of spring tabs 82 may extend from one or more edges of backing plate 44, such as first edge 1, second edge 2, third edge 3, and/or fourth edge 4. In the exemplary embodiment of FIG. 3, each spring tab 82 extends generally from second edge 2 along the transverse direction T, i.e., from the bottom edge of backing plate 44.

Referring now to FIG. 4, each spring tab 82 may be generally C-shaped in an uninstalled position. That is, spring tabs 82 may be generally bent or curved along their length before tabs 82 are installed against control panel frame 36. To install spring tabs 82, pressure may be applied to tabs 82 to press the tabs into channel 41 formed by frame flange 40 at a bottom 37 of control panel frame 36 (FIG. 3). Spring tabs 82 are deformable such that when pressed into channel 41, tabs 82 deform to an installed position, i.e., tabs 82 deform to the shape of channel 41 of frame 36 to maintain continuous contact against control panel frame 36 and thereby provide compression support to backing plate 44. It should be readily understood that spring tabs 82 also may have other shapes or configurations for securing backing plate 44 in place and for providing compression support to backing plate 44. As one example, only a portion of the plurality of spring tabs 82 may be in contact with control panel frame 36 in the installed position, and the remainder of spring tabs 82 may be in contact with another component, such as, e.g., extension element 52.

Figure 6:
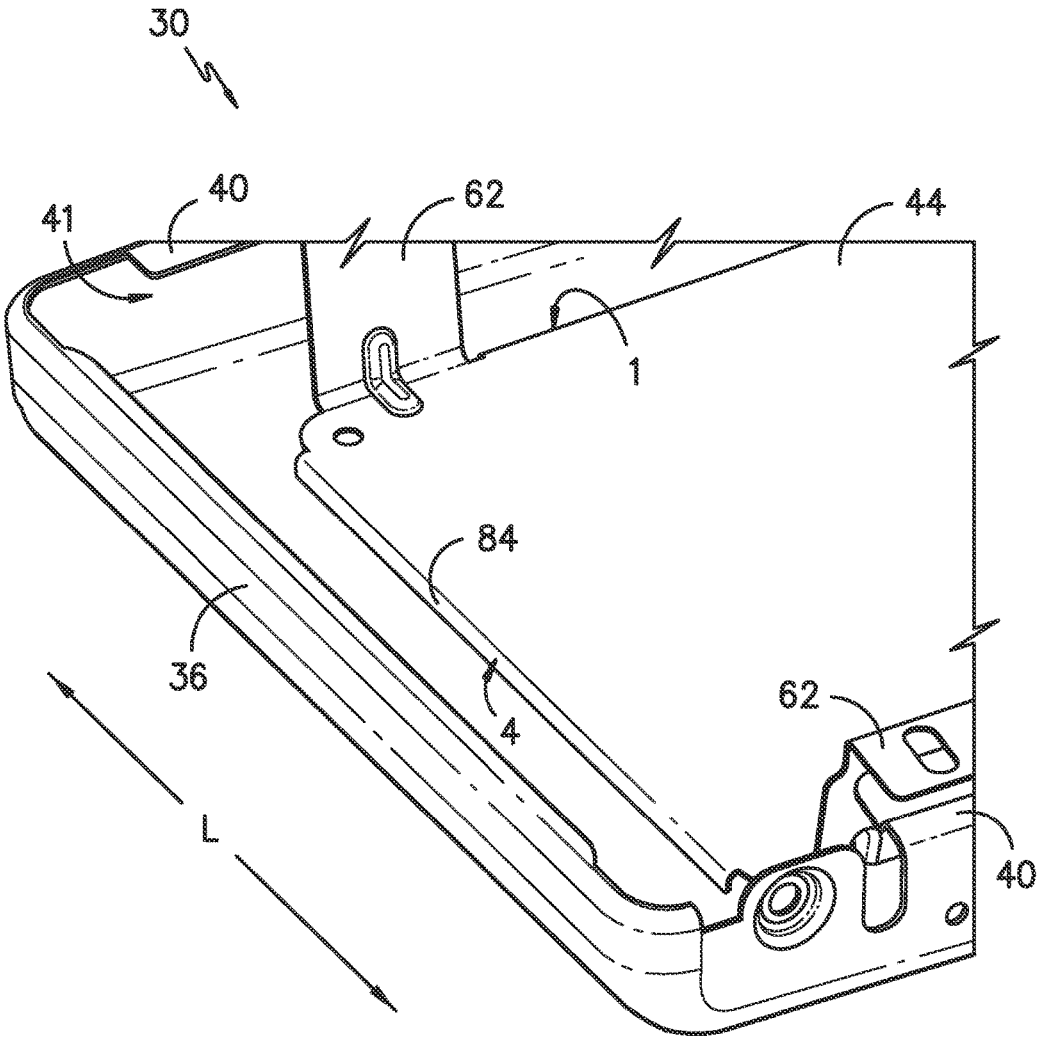
FIG. 6 provides a perspective view of another portion of a control panel assembly according to an exemplary embodiment of the present subject matter.

FIG. 6 provides a perspective view of a portion of control panel assembly 30 according to an exemplary embodiment of the present subject matter. As illustrated, backing plate 44 may include a spacer flange 84 around edges 1, 2, 3, 4 thereof. Spacer flange 84 extends toward control panel frame 36, i.e., in a direction opposite to the direction in which securing tabs 70, 72 and spring tabs 82 extend from backing plate 44. For example, spacer flange 84 may extend generally along the transverse direction T toward control panel frame 36 as shown in the exemplary embodiment shown in FIG. 6. Spacer flange 84 functions as an offset spacer between backing plate 44 and control panel frame 36 and may assist in providing constant or consistent pressure between backing plate 44 and frame 36. Additionally or alternatively, spacer flange 84 allows overlay 42 to expand freely in response to a thermal load, e.g., when overlay 42 is exposed to high temperatures from the cooktop and/or oven. That is, space flange 84 keeps overlay 42 from being squeezed against the control panel frame to prevent deformation of overlay 42 if overlay 42 expands in response to a thermal load.

Providing backing plate 44 having a plurality of securing tabs and spring tabs as described can reduce the number of expensive parts, e.g., by substituting overlay 42 for a glass panel, as well as reduce the overall number of parts and simplify the assembly process of control panel assembly 30, without negatively impacting the look, feel, and function of control panel assembly 30. For example, typical control panel assemblies having glass panels require brackets for holding the glass panel in place that must be fastened to a control panel frame using fasteners such as screws. Control panel assembly 30 as described herein eliminates the glass panel as well as the glass panel brackets and associated fasteners. In addition, typical control panel assemblies require strict adherence to tolerances and/or an assembly process to appropriately install each component of the assembly. However, the securing tabs and spring tabs of backing plate 44 as described do not require precise alignment with control panel frame 36 or another component of control panel assembly 30. Thus, control panel assembly 30 accounts for variations between parts and in the assembly process of control panel assembly 30.

Additionally, it will be understood that the plurality of securing tabs and spring tabs of backing plate 44 may have other configurations for securing backing plate 44 against control panel frame 36 without additional fasteners or requiring backing plate 44 to be at a precise location with respect to control panel frame 36. As one example, each securing tab may have one or more bends or curves along its length when the securing tab is in an uninstalled position, i.e., each securing tab may have an accordion shape. Other configurations of securing tabs may be used as well.

This written description uses examples to disclose the invention, including the best mode, and also to enable any person skilled in the art to practice the invention, including making and using any devices or systems and performing any incorporated methods. The patentable scope of the invention is defined by the claims and may include other examples that occur to those skilled in the art. Such other examples are intended to be within the scope of the claims if they include structural elements that do not differ from the literal language of the claims or if they include equivalent structural elements with insubstantial differences from the literal language of the claims.

What is claimed is:

1. A control panel assembly for an appliance, comprising:

a control panel frame having a frame flange around an edge thereof;

a backing plate adjacent the control panel frame, the backing plate defining a plurality of securing tabs extending from an edge thereof, each securing tab defining an aperture along its length, the backing plate further defining a spacer flange, the spacer flange extending toward the control panel frame;

a control assembly including a control element positioned within a control housing; and an overlay positioned between the control panel frame and the backing plate, wherein each securing tab of the backing plate has an uninstalled position and an installed position, wherein an end of each securing tab farthest from the backing plate is at a greater distance from the backing plate in the installed position than in the uninstalled position.

2. The control panel assembly of claim 1, wherein each securing tab further comprises a hook-shaped portion at an end of the securing tab farthest from the backing plate.

3. The control panel assembly of claim 2, wherein the hook-shaped portion of the plurality of securing tabs contacts the control panel frame when the securing tabs are in the installed position.

4. The control panel assembly of claim 2, further comprising an extension element having an extension flange, the extension element attached to the control panel frame, and wherein the hook-shaped portion of a first portion of the plurality of securing tabs contacts the extension flange when the first portion of the securing tabs is in the installed position.

5. The control panel assembly of claim 4, wherein the hook-shaped portion of a second portion of the plurality of securing tabs contacts the frame flange when the second portion of the securing tabs is in the installed position.

6. The control panel assembly of claim 1, wherein the backing plate comprises four edges, and wherein the spacer flange is defined around the four edges of the backing plate.

7. The control panel assembly of claim 1, wherein the backing plate further defines a plurality of deformable spring tabs.

8. The control panel assembly of claim 7, wherein the spring tabs may be deformed from an uninstalled position to an installed position, and wherein the spring tabs contact the control panel frame in the installed position.

9. The control panel assembly of claim 1, wherein a portion of the securing tabs are first securing tabs and a portion of the securing tabs are second securing tabs, the first securing tabs being longer than the second securing tabs.

10. The control panel assembly of claim 1, wherein, in the uninstalled position, each securing tab is generally curved along its length, and wherein, in the installed position, each securing tab is less curved along its length.

11. A control panel assembly for an appliance, comprising:

a control panel frame having a frame flange around an edge thereof; and a backing plate adjacent the control panel frame, the backing plate defining a plurality of securing tabs extending from a first edge thereof, each securing tab defining an aperture along its length, the backing plate further defining a plurality of spring tabs extending from a second edge thereof, wherein each securing tab of the backing plate has an uninstalled position and an installed position, and each spring tab has an uninstalled position and an installed position, and wherein at least a portion of the plurality of securing tabs contacts the control panel frame in the installed position of the securing tabs and at least a portion of the plurality of spring tabs contacts the control panel frame in the installed position of the spring tabs;

wherein a first portion of the plurality of securing tabs are first securing tabs and a second portion of the plurality of securing tabs are second securing tabs, the first securing tabs being longer than the second securing tabs; and an extension element having an extension flange, the extension element attached to the control panel frame, and wherein the first securing tabs contact the extension flange when the first securing tabs are in the installed position.

12. The control panel assembly of claim 11, wherein each securing tab further comprises a hook-shaped portion at an end of the securing tab farthest from the backing plate.

13. The cooktop appliance of claim 12, wherein each securing tab of the portion of the securing tabs contacting the control panel frame in the installed position contacts the control panel frame at the hook-shaped portion of the securing tab.

14. The control panel assembly of claim 11, wherein the backing plate comprises four edges, and wherein the backing plate defines a spacer flange around the four edges of the backing plate.

15. The control panel assembly of claim 11, wherein, in the uninstalled position, each securing tab is generally curved along its length, and wherein, in the installed position, each securing tab is less curved along its length.

16. The control panel assembly of claim 11, wherein each spring tab is generally C-shaped in the uninstalled position of the spring tabs.

17. The control panel assembly of claim 11, wherein an overlay is positioned between the control panel frame and the backing plate, and wherein the control panel frame defines an opening therein such that the overlay is accessible to a user of the appliance through the opening.

18. A control panel assembly for an appliance, comprising:

a control panel frame having a frame flange around an edge thereof;

a backing plate adjacent the control panel frame, the backing plate defining a plurality of spring tabs extending from an edge thereof, the backing plate further defining a spacer flange, the spacer flange extending toward the control panel frame;

a control assembly including a control element positioned within a control housing; and an overlay positioned between the control panel frame and the backing plate, wherein each spring tab may be deformed from an uninstalled position to an installed position, and wherein each spring tab contacts the control panel frame in the installed position.

* * * * *